United States Patent [19]

Gawlick et al.

[11] 4,320,704

[45] Mar. 23, 1982

[54] ELECTRONIC PROJECTILE FUSE

[75] Inventors: Heinz Gawlick, Furth; Uwe Brede, Schwaig; Hellmut Bendler, Erlangen-Spardorf, all of Fed. Rep. of Germany

[73] Assignee: Dynamit Nobel AG, Troisdorf, Fed. Rep. of Germany

[21] Appl. No.: 494,200

[22] Filed: Aug. 1, 1974

Related U.S. Application Data

[63] Continuation of Ser. No. 262,930, Jun. 9, 1972, abandoned.

[51] Int. Cl.[3] ..... F42C 11/06; F42C 9/16

[52] U.S. Cl. ..... 102/218; 89/6.5; 102/209

[58] Field of Search ..... 102/70.2 R, 70.2 G, 102/70.2 GA, 70.2 P, 70.2 A, 209, 218; 307/110; 89/6.5

[56] References Cited

U.S. PATENT DOCUMENTS

| | | | |
|---|---|---|---|
| 2,555,384 | 6/1951 | Watt | 102/70.2 G |
| 3,034,437 | 5/1962 | Schermer et al. | 102/70.2 GA |
| 3,353,486 | 11/1967 | Haiken | 102/70.2 GA |
| 3,500,164 | 3/1970 | Burkhardt et al. | 307/110 |
| 3,670,652 | 6/1972 | Ziemba | 102/70.2 P |
| 3,703,145 | 11/1972 | Burkhardt et al. | 102/70.2 P |

*Primary Examiner*—Charles T. Jordan

*Attorney, Agent, or Firm*—Craig and Antonelli

[57] ABSTRACT

An electronic switch for projectiles includes a circuit with a source of electric energy which is switched in when the projectile is discharged. The circuit includes an adjustable time-delay device for the explosion of the projectile, a device for preventing muzzle burst, and a self-destruct arrangement. The exploding fuse is connected to the source of energy by an impact or a proximity switch. The self-destruct arrangement is settable by cooperating cells carried by the projectile and by the barrel of the gun.

8 Claims, 5 Drawing Figures

ELECTRONIC PROJECTILE FUSE

This is a continuation of application Ser. No. 262,930, filed June 9, 1972, now abandoned.

BACKGROUND OF THE INVENTION

1. Field of the Invention

The invention relates to electronic fuses for shells, projectiles, or the like with a switch, a detonator and a bursting charge.

2. The Prior Art

It is known, in projectile fuses, which work with impact or proximity switches, to construct the time control mechanisms from pyrotechnic or mechanical structural elements. In a projectile fuse, functions which must be especially borne in mind are the prevention of muzzle burst, possibly explosion delay and self-destruction.

SUMMARY OF THE INVENTION

The purpose of the invention is to make possible the construction of a simple extremely reliable electronic fuse which fulfills the above stated functions without moving parts.

According to the invention an electronic fuse is provided which is characterized by an electrical energy storing part, advantageously motivated by the discharge, a control arrangement for the muzzle burst security time, an adjusting arrangement for the explosion delay time and a self-destruct part with a programmable unit. Among the above mentioned adjustable function times, either the energy storing element together with the control arrangement for the muzzle burst security time and the adjusting arrangement for the explosion delay time together form an impulse supply means for supplying a firing impulse through the switch to the detonator or else, in case of a non-functioning condition of the switch, the impulse to the fuse of the detonator is given after the expiration of the muzzle burst prevention time over the programmable self-destruct part. A fuse according to the invention is further characterized in that the control arrangement, the adjusting arrangement and the self-destruct part constitute a control circuit with in each case its own self-contained structure. Through a development of a special control element of an electronically integrated unit with the provision of a thyristor in the anode-cathode connection and the provision of an exact trigger diode in the control circuit, the construction of a simple electronic fuse which is reliable under extreme physical conditions is made possible. The control element is used in connection with an adjustable time circuit, for example an electrical RC link. Through the similarity of the operating circuits for the time control of the muzzle burst prevention, the self-destruction and the explosion delay, there is made possible a selection of the adjustment of the requirements with relation to time which results from the insertion range of a projectile. The muzzle burst prevention time and the explosion delay time are then maintained fixed by the electrical RC link, whereas in the adjusting arrangement for the explosion delay time an additional switch is provided by means of which the explosion delay can be adjusted as desired.

According to a further feature of the invention, the self-destruct time of the electronic fuse can be additionally programmed, even without requiring that the built-in energy source be activated. This programming can for example follow without current through a coil by means of a magnetic field provided at the muzzle of the gun. This magnetic field at the muzzle of the gun can for example be produced by another coil which can be characterized as the muzzle coil. This muzzle coil is mounted by an extension in front of the gun. The programming of the self-destruct time according to the invention, which at the insertion of the shell, depending on the target distance and the requirements can be achieved independently of the built-in energy source, enlarges not only the insertion range of the foregoing projectile fuse to a substantial extent, but permits also longer operating time of the built-in energy source, for example a battery with a direct voltage transformer or a direct current generator.

Other characteristics of the invention are that a firing condenser is connected after the control arrangement which can be activated by the energy source, to which, after the expiration of the muzzle burst prevention time by the adjustable time element, the firing current for the detonator is switched by the control circuit to the ready position. Thus the firing current can be transmitted to the detonator over the switch which makes contact when the shell strikes. For the selected adjustment of the delayed or the undelayed firing of the detonator after the shell strikes, an adjustment switch for the adjustment arrangement is provided. In this respect according to a special feature of the invention, in case of a delayed firing, the explosion delay time is adjustable as a function of the time of flight, for example by means of a resistor connected in parallel with the firing condenser and reducing the firing current according to an exponential function. Thus despite increasing time of flight of the projectile, through the special characteristics the explosion delay switch, a constant explosive action of the projectile is achieved. The projectile detonates then after a longer flight time comparatively later than with a shorter flight time, so that the fuse after striking the target always detonates after a constant multiple of the flight time.

BRIEF DESCRIPTION OF THE DRAWINGS

Further features of the invention will be apparent from the following description taken into consideration with the accompanying drawings, in which.

DESCRIPTION OF THE PREFERRED EMBODIMENTS

Figure 1:
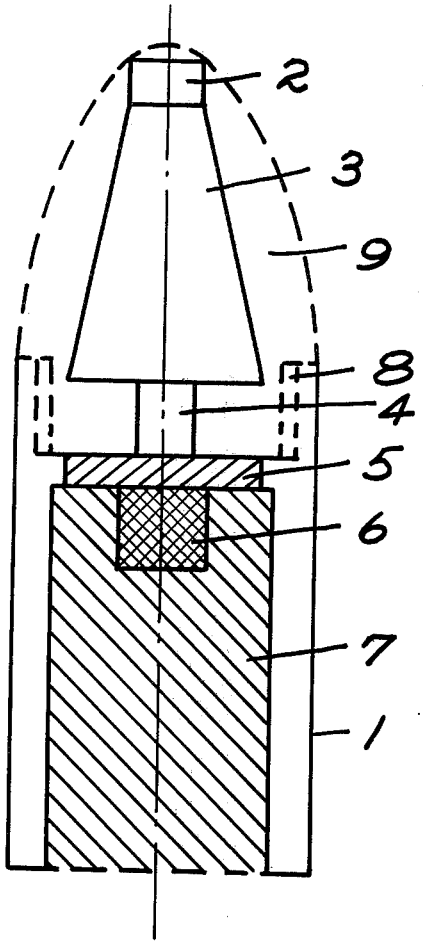
FIG. 1 shows the construction of the projectile with a fuse according to the invention.

The fuse shown in FIG. 1 has in its nose cone 9 the electric fuse 3 with an impact switch 2 at the point. Instead of the impact switch 2, another target-actuated switch, such as an electronic proximity switch, can just as well be used. The electronic switch 3 rests on the detonator 4, for example an electronic detonator, on which the electronic fuse works for example through a metal layer element. Such detonators are extraordinarily mechanically stable and reliable in operation. The detonator 4 is secured by the detonator safety ring 5, for example a mechanical detonator safety, which is released by the rotational acceleration of the shell. The main bursting charge 7 and the booster 6 complete the shell. Screw coupling 8 between the nose of the shell and the body of the shell is constructed as a fracturable part, in order to produce an increase in the transportability of the detonator if this works on the detonator safety in the save position.

Figure 2:
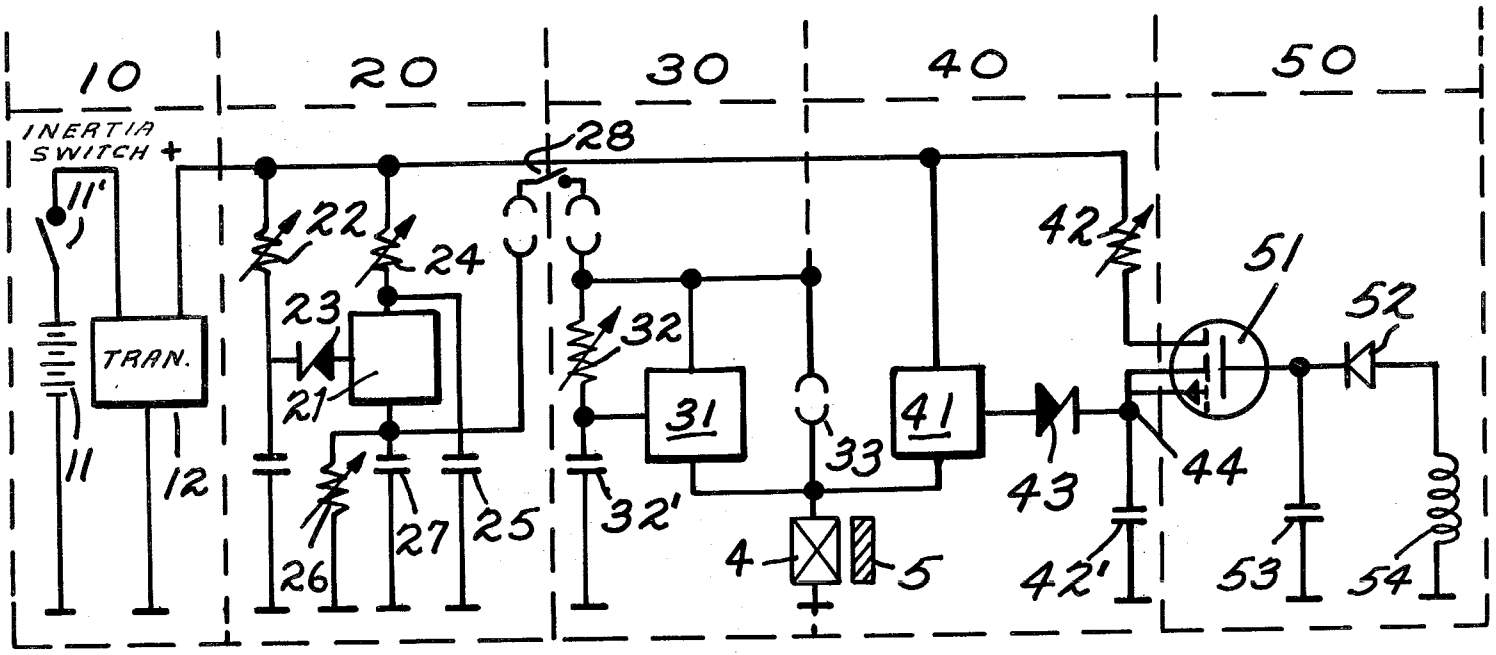
FIG. 2 shows the electric circuit of the electronic fuse.

In FIG. 2 is a circuit diagram of the electronic fuse. The fuse consists of an electrical energy source 10 activatable through the discharge, a control arrangement 20 for the muzzle burst safety time, an adjustment arrangement 30 of the explosion delay time, the self-destruct part 40 and the programming unit 50 for the self-destruct part.

The energy storing part 10 consists for example of the battery 11 with the direct voltage transformer 12 and an inertia switch 11'. The activation of the energy storage part 10 in connection with a battery 11 is carried out during the acceleration by the discharge in the gun through the switch 11'.

The control arrangement 20 for the muzzle burst safety time consists in general of an electronic control circuit 21 with a pre-connected electric time circuit 22, a so-called RC link, as well as a diode 23, resistance 24 and a condenser 25. The resistance 24 and the condenser 25 provide an additional safety, because an undesired firing of the control circuit 21 by a very sharp increase of current through the energy source 10 is prevented. The diode 23 constitutes a device which helps to make it possible to work with the control element 21 in the chosen current range. The function of the diode 23 is that the control circuit 21 fires only upon exceeding a pre-determined threshold current, which must be considered to be in connection with the time setting of the control arrangement 20. The electronic control element 21 is characterized by the provision of a thyristor in the anode-cathode connection and provision of a trigger diode in the control circuit. This control element is for instance so dimensioned that it has a maximum control current of 10/u A, an anode voltage range of 5 V to 80 V and an output current of 10 A, and is not self-fired by an increase in anode current speed (steepness) of $10^8$ V/sec. After the expiration of the muzzle burst safety time regulated through the time circuit 22, the control circuit 21 connects the firing current to the firing condenser 27. By this the firing energy is furnished. Parallel to firing condenser 27 a resistance 26 is connected, through which the current in the firing condenser 27 in line with the programmed time of flight decreases according to the exponential function. The time constant is adjusted in direct proportion to the velocity-time ratio of the projectile. In this way the explosion delay can be adjusted as a function of the flight time, so that the explosion track is automatically kept constant even with different impact speeds of the shell.

The contact 28 of the impact switch 2 constitutes the connection between the control arrangement 20 and the adjusting arrangement 30 for the explosion delay time and serves for the transmission of the firing current stored in the fuse condenser 27 to the detonator 4. The adjusting arrangement 30 further includes the central electric control circuit 31 with the adjustable electronic RC link 32, 32'. By means of the adjustment switch 33 the firing current can be switched over the control circuit 31, to the detonator 4 either with or without delay.

When the switch 2 through the landing of the shell and before the expiration of the self-destruct time applies the contacts at the contact 28, then the detonator 4 is fired either with or without delay. The switch connection of the adjustment switch 33 to the preadjustment of the explosion delay during the production of the electronic fuse part is carried out through charging or discharging of a short circuit bridge in the adjustment switch 33 (see also FIG. 1).

The self-destruct part 40 consists of a central electric control element 41 with a preconnected electrical RC link 42, 42' for the time adjustment and the diode 43 which works similar to the diode 23. Independently of the self-destruct time which is adjustable by the RC link 42, 42', this can be varied through the program unit 50 after-connected over the connection point 44 in each case by the insertion of the shell. The essential structural element of the program unit 50 is the coil 54, which, through the influence of more or less strong magnetic induction which is produced at the muzzle of the gun, programs the self-destruct time. The strength of the output of the magnetic induction of the program coil 54 is determined by the shell velocity Vo as well as by the strength of the static magnetic fields of a muzzle coil arranged at the mouth of the gun and its length. In the program coil 54 of the projectile a current is induced when the shell passes through this muzzle coil which is mounted for wireless programming of the self-destruct time in front of the gun. The coil 54 can either be connected over the diode 52, condenser 53 and the field transistor 51 to the self-destruct unit or as shown in FIG. 3 over the diodes 55, 57 and zener diode 56.

The programming is in this way controlled by the coil length of the muzzle coil mounted in front of the gun.

Figure 3:
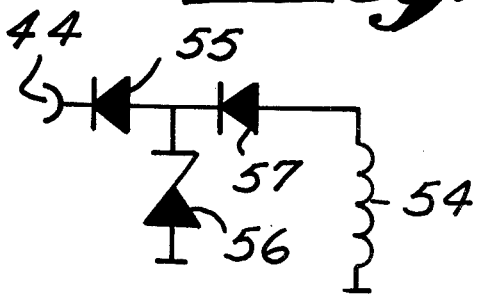
FIG. 3 shows a variant of the programming arrangement of FIG. 2.

For this it is however necessary that the magnetic field strength of the muzzle coil, through which the projectile passes when it is discharged, should be great enough to exceed the threshold current of the zener diode 56 according to FIG. 3 or the threshold value of the field effect transistor 51 according to FIG. 2. The timewise programming can be carried out in a simple way, if the muzzle coil on the gun is separated lengthwise into several zones. For example, for a short self-destruct time, through the programming circuit 50 of FIG. 2 of the self-destruct circuit 40, a greater charge must be pre-programmed on the condenser 42' than for a longer self-destruct time. This is accomplished in that for example the whole length of the coil (the whole magnetic field) is electronically connected; correspondingly for longer self-destruct times only part of the zones of the muzzle coil are provided with current (shorter length of magnetic field).

The procedure of the programming arrangement is as follows:

Because of the muzzle velocity of a selected type of shell has extremely small variations, the time which the shell requires for passing a predetermined coil length is quite constant. However the length of the magnetic field through deliberate switching in of different sections of the coil can be varied in length, and in the program coil 54 of the shell a current is produced sometimes for longer times and sometimes for shorter times. The condenser 42' and the programming part of FIG. 2 is correspondingly charged more or less. The small charging gives a long self-destruct time, with greater charging the reverse is true.

By the discharge of the shell the energy source part 10 is activated. In this it is important that for example the battery is first activated by the discharge and in the non-active condition is short circuited, so that the fuse is not rendered inoperative by an undesired activation leading to discharge of the battery. Simultaneously with the activation of the energy storing part 10, the detonator safety 5 through the rotation acceleration moves out and leaves the fuse transmitting train free. In consequence of the current supply of the energy source 10, the time control 21 for the muzzle burst safety time begins to operate and the time control 42, 42' for the self-destruct. In accordance with the distance of the target, for example measured by radar, through the coil surrounding the muzzle of the gun a current can be induced as needed in the program coil 54, which varies, in accordance with the intensity and length of field of the muzzle coil on the gun, the self-destruct time in the preadjusted self-destruct part 41, 42. For this change the supply of current from the energy source 10 is not necessary.

The muzzle burst safety of the shell is achieved by the fact that the switch 2 can first be conductive of current when the preset time for the muzzle burst safety in the control arrangement 22 has expired. After the expiration of the adjusted muzzle burst safety time, the firing current is switched to the firing condenser 27 and stored. If the impact switch 2 through the impact of the shell before the expiration of the adjusted self-destruct time make contact, then according to the pre-adjustment of the time elements 31,32 and the switch 33 with or without delay the detonator 4 is fired over the time element 31.

With reference to the use of the electronic fuse, instead of the impact switch 2 on the contact 28, an electronic proximity switch could also be used.

If within the programmed self-destruct time no target is hit by the shell, that is the switch 2 as well as the contact 28 have not closed, the detonator 4, corresponding to the self-destruct time programmed upon the time circuit 42 and the program unit 50, is automatically fired over the control circuit 41. The necessary delay time for the shell under consideration lies between about 1 millisecond and 10 seconds and can be adjusted with the time-control circuits provided according to the invention.

Figure 4:
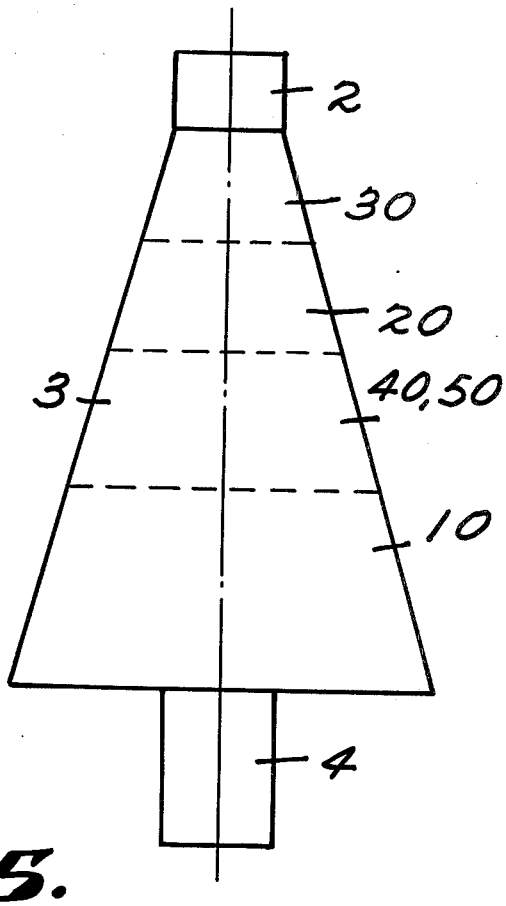
FIG. 4 shows the unitary construction of the electric switch.

In FIG. 4 the unitary construction of the electronic switch with the switch 2 in the nose is shown. It is preferred to make it in tiers, which has the advantage that all the operational groups 10, 20, 30, 40 and 50 can be manufactured separately as box elements and tested and then be assembled together in the form of a fuse.

Figure 5:
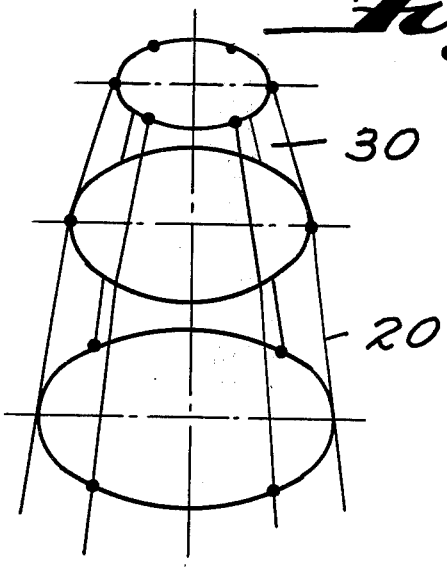
FIG. 5 shows details of the arrangement according to FIG. 4.

The impact switch 2 is arranged in the nose of the shell, and therebelow the adjusting arrangement 30 for the explosion delay time. Therebeneath follows the control arrangement 20 for the muzzle burst safety time with the fuse condenser and thereafter the program part 50 for the self-destruct time and the self-destruct part 40. The program coil 54 is so arranged that it coincides in shape with the surface of the shell casing. The base of the pyramid of the electronic switch constitutes the energy storing part 10 with the detonator 4. The individual structural parts are connected through a contact system in the angle screen on the outer circumference of the switch unit, see FIG. 5, which are connected by a special acceleration-resistant plug system. The whole electronic part is then assembled into a structural unit with the detonator and magnetic switch, in order to be able to undergo high acceleration and to assure exceptional transport safety.

The foregoing electronic projectile fuse according to the invention is suitable especially for all calibers above 20 mm and fulfills through the use of a new electronic switch circuit, which has been especially developed for this purpose, the functions of safety against muzzle burst, selective adjustment with or without explosion delay by simultaneous equalization of the explosion delay time with the flight time, and a self-destruct time programmable through external magnetic impulses at the muzzle with high reliability and without movable parts for the function mechanisms.

We claim:

1. Electronic fuse for projectiles having a switch, a detonator and an explosive charge, said fuse comprising a source of electrical energy, means responsive to discharge of the projectile to render said energy source operative, a control mechanism for preventing muzzle burst, an adjustable mechanism for determining the time delay of explosion and a programmable self-destruct mechanism, all said mechanisms being connected to said energy source, said mechanisms being provided with control elements and formed as self-contained units, the control mechanism including an electronic integrated circuit having an anode-cathode connection with a thyristor in the anode-cathode connection and a trigger diode.

2. Electronic fuse for projectiles having a switch, a detonator and an explosive charge, said fuse comprising a source of electrical energy, means responsive to discharge of the projectile to render said energy source operative, a control mechanism for preventing muzzle burst, an adjustable mechanism for determining the time delay of explosion and a programmable self-destruct mechanism, all said mechanisms being connected to said energy source, the source of electrical energy being a battery provided with a direct voltage transformer.

3. Electronic fuse for projectiles having a switch, a detonator and an explosive charge, said fuse comprising a source of electrical energy, means responsive to discharge of the projectile to render said energy source operative, a control mechanism for preventing muzzle burst, an adjustable mechanism for determining the time delay of explosion and a programmable self-destruct mechanism, all said mechanisms being connected to said energy source, said fuse including a firing condenser, said muzzle burst preventing mechanism including means to connect said condenser to the energy source after the passage of a predetermined time from discharge of the projectile, whereby the energy for firing the detonator is stored in the condenser, said connecting means including a resistance means connected in parallel to the firing condenser to cause the firing current to decrease according to an exponential function.

4. Electronic fuses as claimed in claim 3, in which said self-destruct mechanism includes a coil in which current can be induced by a magnetic field producing means at the muzzle of a gun.

5. Electronic fuses as claimed in claim 4, in which the self-destruct mechanism includes a diode connected to said coil, a condenser, and a field effect transistor connecting said diode and said condenser of said self-destruct mechanism.

6. Electronic fuses as claimed in claim 4, in which the self-destruct mechanism includes a diode connected to said coil, a condenser and a zener diode connecting said diode and said condenser of said self-destruct mechanism.

7. Electronic fuses as claimed in claim 4, in which said coil conforms in shape to the outer surface of the projectile.

8. Electronic fuse for projectiles having a switch, a detonator and an explosive charge, said fuse comprising a source of electrical energy, means responsive to discharge of the projectile to render said energy source operative, a control mechanism for preventing muzzle burst, an adjustable mechanism for determining the time delay of explosion and a programmable self-destruct mechanism, all said mechanisms being connected to said energy source, means independent of the energy source for programming the self-destruct mechanism, said programming means including a coil in which current can be induced by a magnetic field producing means at the muzzle of a gun.

* * * * *